US007662073B1

(12) United States Patent
Baldwin

(10) Patent No.: US 7,662,073 B1
(45) Date of Patent: Feb. 16, 2010

(54) APPARATUS AND METHOD FOR LIFTING WEIGHTS

(75) Inventor: Terry Baldwin, Alberton, MT (US)

(73) Assignee: Flexsolate, LLC, Missoula, MT (US)

( * ) Notice: Subject to any disclaimer, the term of this patent is extended or adjusted under 35 U.S.C. 154(b) by 0 days.

(21) Appl. No.: 11/059,230

(22) Filed: Feb. 16, 2005

Related U.S. Application Data

(60) Provisional application No. 60/552,915, filed on Mar. 12, 2004.

(51) Int. Cl.
*A63B 21/00* (2006.01)
*A63B 71/00* (2006.01)

(52) U.S. Cl. ..... 482/92; 482/139

(58) Field of Classification Search ..... 482/23, 482/24, 104–109, 139, 44, 49, 50, 91–93; 2/161.1, 162, 131.1; 602/4, 20, 21; 128/878, 128/879; 119/725, 769, 792, 793, 795
See application file for complete search history.

(56) References Cited

U.S. PATENT DOCUMENTS 3,554,194 A * 1/1971 Johnson ..... 602/4
3,923,050 A * 12/1975 Zeide et al. ..... 602/4
4,322,077 A * 3/1982 Van't Hof ..... 473/551
4,659,078 A * 4/1987 Blome ..... 482/110
4,807,876 A * 2/1989 Lothar ..... 482/139
4,867,444 A * 9/1989 Castillo ..... 482/106
4,998,723 A * 3/1991 Santoro ..... 482/104
5,076,288 A * 12/1991 Millard et al. ..... 128/869
5,090,691 A * 2/1992 Pollock ..... 482/139
5,307,966 A * 5/1994 Inaba et al. ..... 224/578
5,324,244 A * 6/1994 Miller et al. ..... 482/106
5,518,486 A * 5/1996 Sheeler ..... 482/131
5,588,942 A * 12/1996 Dillard ..... 482/139
5,624,388 A * 4/1997 Lehr ..... 602/20
5,745,920 A * 5/1998 Olivier ..... 2/170
5,746,685 A * 5/1998 Glaser ..... 482/93
5,813,368 A 9/1998 Rasmussen ..... 119/799
5,921,903 A * 7/1999 Lawrence ..... 482/140
5,997,494 A 12/1999 Watkins et al. ..... 602/36
6,059,693 A * 5/2000 Myers ..... 482/44
6,168,556 B1 * 1/2001 Saavedra ..... 482/93
D439,942 S * 4/2001 Ray ..... D21/694

(Continued)

FOREIGN PATENT DOCUMENTS

CH 603153 A5 * 8/1978

*Primary Examiner*—Loan H Thanh
*Assistant Examiner*—Allana Lewin
(74) *Attorney, Agent, or Firm*—Steptoe & Johnson PLLC

(57) ABSTRACT

A dynamically adjustable weight lifting aid that eliminates hand grip strength as the limiting factor in weight lifting, including a strap and a slidable sleeve encircling the strap. The strap has a wrist loop at one end and an attachment loop at the other end. The attachment loop is suitable for removably attaching the strap to a weight bar or other handle on a weight lifting system or machine. The wrist loop is suitable for receiving a person's wrist. Specifically, the person's hand is inserted through the wrist loop, and the person's palm contacts the slidable sleeve. The wrist loop cradles the person's wrist, and the effective diameter of the wrist loop is dynamically adjustable by the person's hand by sliding the slidable sleeve in either direction along the length of the strap. The person may then lift a weight of the weight lifting system by pulling on the strap.

11 Claims, 10 Drawing Sheets

U.S. PATENT DOCUMENTS 6,216,319 B1 * 4/2001 Elkins ..... 24/3.2
D459,772 S 7/2002 Meldeau ..... D21/662
6,447,037 B1 * 9/2002 Crouch ..... 294/149
D464,686 S 10/2002 Silveira et al. ..... D21/662
7,172,522 B1 * 2/2007 Harvey ..... 473/450
2002/0068666 A1 * 6/2002 Bruccoleri ..... 482/93
2003/0014002 A1 * 1/2003 Quintana ..... 602/64
2003/0148861 A1 * 8/2003 McBride ..... 482/92

* cited by examiner

APPARATUS AND METHOD FOR LIFTING WEIGHTS

CROSS-REFERENCES TO RELATED APPLICATIONS

This application claims the benefit of U.S. Provisional Application No. 60/552,915 filed Mar. 12, 2004.

BACKGROUND OF THE INVENTION

1. Field of the Invention

This invention relates to weight lifting aids, and in particular, to a wrist strap adapted for use with a weight lifting system and designed to reduce reliance upon hand grip strength during weight lifting, as well as a telescoping weight bar suitable for use with the wrist strap.

2. Description of the Related Art

Weight lifting is both a popular sport and a means of increasing physical fitness through strength training. When lifting weights, the hands and fingers of a person are typically wrapped around a bar, handle, or similar handhold such that the weight is firmly gripped and therefore manipulable by the person. If the person unexpectedly or accidentally loses a tight grip on the handhold, even momentarily, then he or she may drop the weight and/or compensate for the sudden loose grip by immediately making a stiffening, jerking, or twisting body motion. Such a quick body motion undertaken while the muscles are still under stress can lead to soft tissue or muscular injury. Similarly, if the person lacks the ability or strength to firmly grip or consistently maintain a firm grip on a weight, then he or she may be unable to participate in a conventional weight lifting regimen.

Accordingly, technology has been developed in an attempt to enhance the gripping ability of a person or to enable a person to lift or pull weights or other heavy objects without reliance upon strong grip strength. For example, U.S. Pat. App. Pub. No. US 2003/0148861 published Aug. 7, 2003, for McBride, describes a grasping and lifting aid comprising a flexible strap that loops around the user's wrist then wraps around a weight bar. A portion of the strap has anti-slip properties such that the user's hand is less apt to slip when he or she grasps the wrapped weight bar. Although this device enhances a user's gripping ability by reducing slippage, it is not designed to significantly obviate the need for a strong and consistent hand grip during weight lifting.

U.S. Pat. No. 5,813,368 issued to Rasmussen on Sep. 29, 1998, describes a hand-held dog restraint wherein the user inserts his hand and wrist through a wrist loop, then grasps a padded hand grip on a rigid bar, the far end of which has a dog collar attachment clip. The wrist loop, therefore, does not eliminate the need to tightly grip the rigid bar, as it only serves as a back-up to keep the bar in easy reach if the user loses his or her grasp on the rigid bar. The wrist loop is not adjustable in size as it is not meant to wrap tightly around the user's wrist.

U.S. Pat. No. 6,168,556 issued to Saavedra on Jan. 2, 2001, describes a wrist strap apparatus for use in weight training comprising a wrist strap having a connected dependent strap portion with a spring clip or carabiner for attachment to weight training equipment. The strap is wrapped around a user's wrist and secured thereto using a hook and loop fastener. A thumb loop circles around the user's thumb to help keep the strap in place around the user's wrist. This device can remove hand grip strength as a limiting factor in weight lifting. However, once it is wrapped around a user's wrist it cannot be loosened, tightened, or otherwise adjusted to more comfortably fit around the user's wrist without first unhooking and unwrapping it, then re-wrapping it in the desired position. Such a maneuver could not be accomplished during a lift and could not be accomplished between lifts without stopping the lifting routine. Thus, this device is not designed to permit small, but potentially very comforting, adjustments of the tightness or position of the strap around the user's wrist during a lift or between lift repetitions.

Additionally, placement and securing of the Saavedra strap around the wrist requires the use of both of the user's hands or the assistance of another person. Thus, two of these devices could not remain attached to the ends of a typical weight bar (i.e., one device attached to each end of the bar) such that a person could walk up to the weight machine and attach the device on one end of the bar to one of his or her wrists then attach the device on the other end of the bar to his or her other wrist (unless the bar was very short). The reason for this is that once the person had secured one wrist to one device, that hand could not reach over to assist in securing the other wrist to the other device. One or both of the devices would first have to be removed from the weight machine, or alternatively the assistance of a second person would be needed. The following publications disclose similar weight lifting wrist strap devices using hook and loop fasteners for securing the device onto a user's wrist, thus resulting in the same limitations described above for the Saavedra device: U.S. Pat. No. 5,997,494 issued to Watkins et al. on Dec. 7, 1999; U.S. Des. Pat. No. D459,772 issued to Meldeau on Jul. 2, 2002; and U.S. Des. Pat. No. D464,686 issued to Silveira et al. on Oct. 22, 2002.

SUMMARY OF THE INVENTION

It is thus an object of the present invention to provide an apparatus and method for lifting weights whereby hand grip strength is eliminated as the limiting factor in the weight lifting process.

It is a further object of the present invention to provide a simple, comfortable, inexpensive, and easy-to-use device that obviates the need for a strong and steady hand grip during weight lifting.

It is a further object of the present invention to provide a weight lifting aid that has a dynamically adjustable fit around a user's wrist during the weight lifting process wherein such adjustability does not require the removal of the aid from the wrist, the interruption of the weight lifting process, the use of two hands, or the assistance of others.

It is a further object of the present invention to provide a weight stabilizing device adapted to be used with a conventional weight lifting system.

It is a yet a further object of the present invention to provide a weight lifting aid that possesses the structural strength and durability needed to function properly under the mechanical stresses to which weight lifting equipment is exposed.

Accordingly, a weight lifting device is provided that includes a strap and a slidable sleeve encircling the strap. The strap has a wrist loop at one end and an attachment loop at the other end. The slidable sleeve can slide over the wrist loop away from the attachment loop, thereby decreasing the effective diameter of the wrist loop. Conversely, the slidable sleeve can slide over the wrist loop toward the attachment loop, thereby increasing the effective diameter of the wrist loop. In use, the attachment loop is removably attached to a weight bar or handle of a weight lifting machine or system. A person inserts his or her hand through the wrist loop such that his or her palm comes into contact with the slidable sleeve. The person pulls on the strap such that a weight on the weight lifting system is lifted, without the need for tightly grasping a bar or handle with his or her hand and fingers. The person may adjust the effective diameter of the wrist loop by sliding the slidable sleeve at any time using his or her hand that is in contact with the slidable sleeve. Furthermore, a telescoping weight bar is provided that is suited for use in conjunction with the weight lifting device.

BRIEF DESCRIPTION OF THE FIGURES

The present invention is described with reference to the accompanying drawings. In the drawings, like reference numbers indicate identical or functionally similar elements. Additionally, the left-most digit of a reference number identifies the drawing in which the reference number first appears.

DETAILED DESCRIPTION OF THE PREFERRED EMBODIMENTS

Figures 1A, 1B:
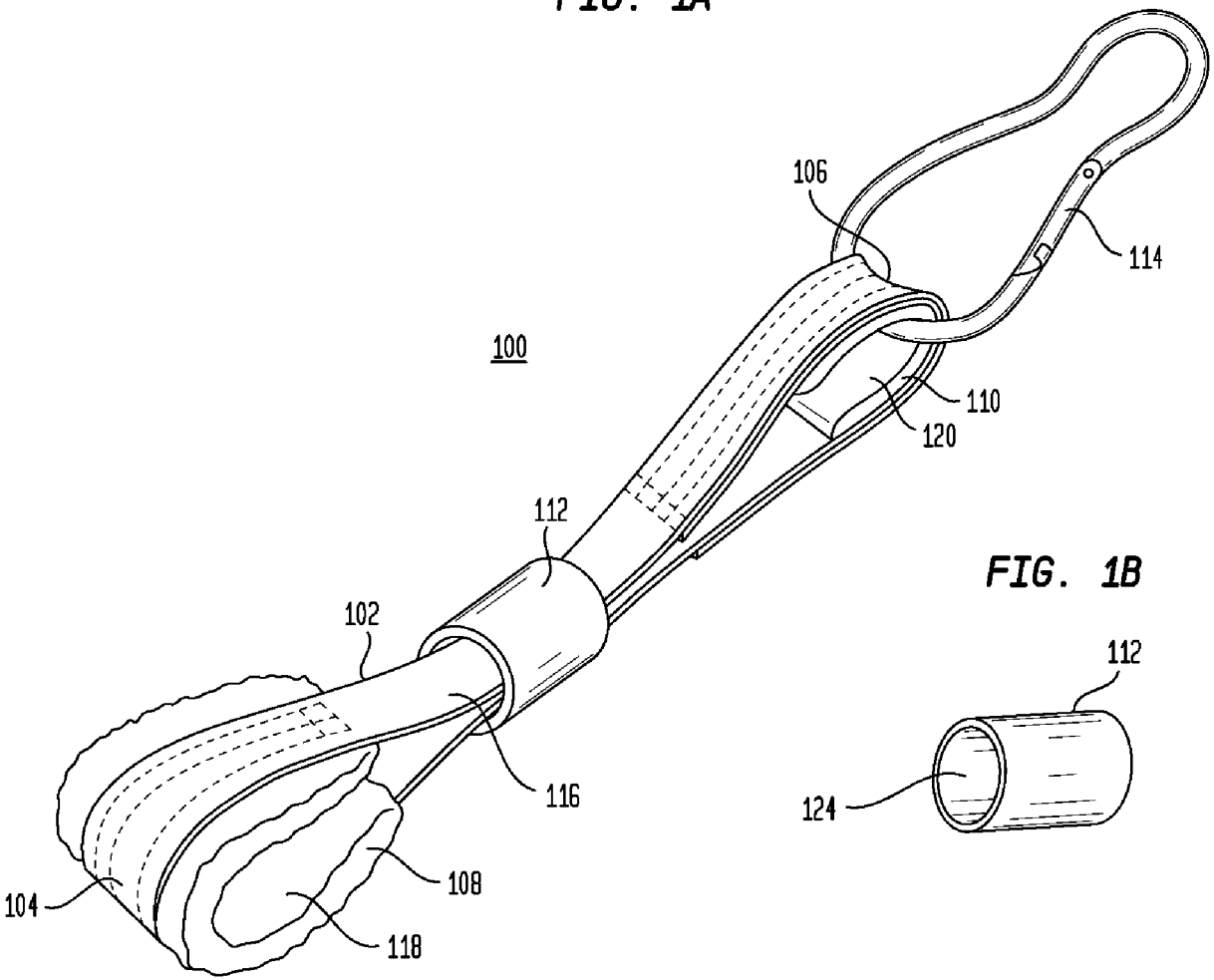
FIG. 1 is a perspective view of a preferred embodiment of a weight lifting apparatus 100 of the present invention.

In a preferred embodiment of the present invention shown in FIG. 1A, the weight lifting apparatus 100 comprises a strap 102 folded and attached together in a continuous circle or loop. The strap 102 is preferably made of one and one-half inch wide nylon, although any other material having similar flexibility, strength, and durability may be used such as leather, canvas, fabric, etc. The strap 102 preferably has an overall circumference of about twenty-four inches, although differing sizes may be used based upon the gender or preference of the user. A sliding mechanism or slidable sleeve 112 encircles the strap 102. The slidable sleeve 112 is preferably a short tube having an inside diameter slightly smaller than the width of the strap 102. More specifically, the slidable sleeve 112 is preferably a one and one-half inch long section of circular plastic tubing having an inside diameter of one inch, as shown in FIG. 1B. Thus, the slidable sleeve 112 is movably attached to the strap 102 by temporarily flattening or compressing at least a portion of the strap 102 such that the strap 102 can be threaded through the center hole 124 in the slidable sleeve 112. The slidable sleeve 112 can then be slid further along the strap 102 such that the slidable sleeve 112 is approximately centered on the strap 102. The strap 102 therefore has a first end 104, a middle section 116, and a second end 106, wherein the slidable sleeve 112 movably slides over the middle section 116. The materials and dimensions described herein for the strap 102 and the slidable sleeve 112 are for convenience. It would be readily apparent to one of ordinary skill in the relevant art to use different materials and dimensions.

After the slidable sleeve 112 is positioned over the middle section 116, the strap 102 can be unflattened to form two loops separated by the slidable sleeve 112. A wrist loop 118 is formed at the first end 104, and an attachment loop 120 is formed at the second end 106. As the slidable sleeve 112 is positioned or slid along the middle section 116 of the strap 102, the effective diameters of the wrist loop 118 and the attachment loop 120 increase and decrease accordingly. For example, as the slidable sleeve 112 slides toward the first end 104, the effective diameter of the wrist loop 118 decreases whereas the effective diameter of the attachment loop 120 increases. On the other hand, as the slidable sleeve 112 slides toward the second end 106, the effective diameter of the attachment loop 120 decreases whereas the effective diameter of the wrist loop 118 increases.

In the preferred embodiment shown in FIG. 1A, padding 108 is secured to the interior surface of at least part of wrist loop 118. This padding 108 is preferably glued or stitched in place and is made of a material that is soft, cushiony, pliant, etc., such as foam, cotton, neoprene, and the like. The function of the padding 108 is to make the weight lifting apparatus 100 more comfortable to use by providing a soft cushion between the wrist loop 118 and the user's wrist when the user inserts his or her hand and wrist through the wrist loop 118 and pulls on the weight lifting apparatus 100. The padding 108 is preferably generally rectangular in shape and wider than the width of the wrist loop 118 in order to make the weight lifting apparatus 100 even more comfortable to the user. That is, the wider padding 108 protects the user's skin on his or her hand and wrist from the pressure generated at the wrist loop 118 edges as the user pulls on the weight lifting apparatus 100, thereby reducing the pinching or cutting of the wrist loop 118 edges into the back and sides of the user's hand and wrist during use. Preferred dimensions for the padding 108 are about six inches long and about two and one-half inches wide. However, the materials and dimensions described herein for the padding 108 are for convenience. It would be readily apparent to one of ordinary skill in the relevant art to use different materials and dimensions.

Figure 4:
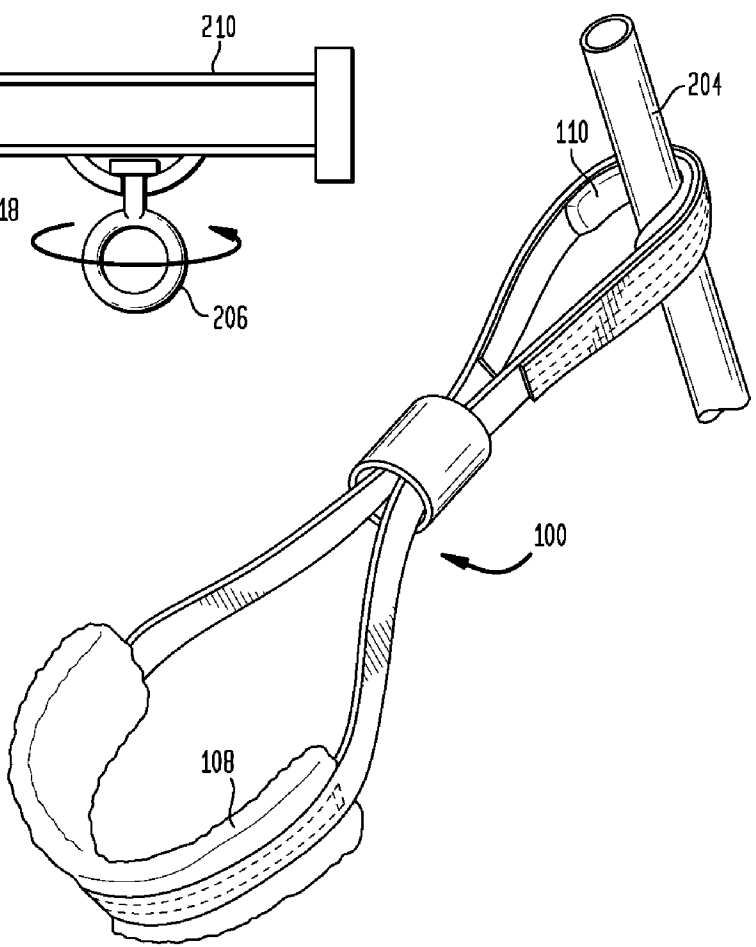
FIG. 4 is a perspective view of the weightlifting apparatus 100 attached to the telescoping cross bar 204 by an alternative means.

A protective pad 110 is also preferably secured to the interior surface of at least part of the attachment loop 120 at the second end 106. The protective pad 110 is preferably glued or stitched in place. The protective pad 110 is preferably generally rectangular in shape, about the same width as the attachment loop 120, and about four inches long. The protective pad 110 is preferably made of rubber or similar material that reduces slippage of the attachment loop 120 when it is placed on a bar 204 as shown in FIG. 4. The protective pad 110 also serves to reduce wear and tear on the attachment loop 120 through use of the weight lifting apparatus 100 over time. Optionally, a spring clip 114, carabiner, or similar removable attachment device may be attached to the attachment loop 120. The materials and dimensions described herein for the protective pad 110 and the spring clip 114 are for convenience. It would be readily apparent to one of ordinary skill in the relevant art to use different materials and dimensions.

Figure 2A:
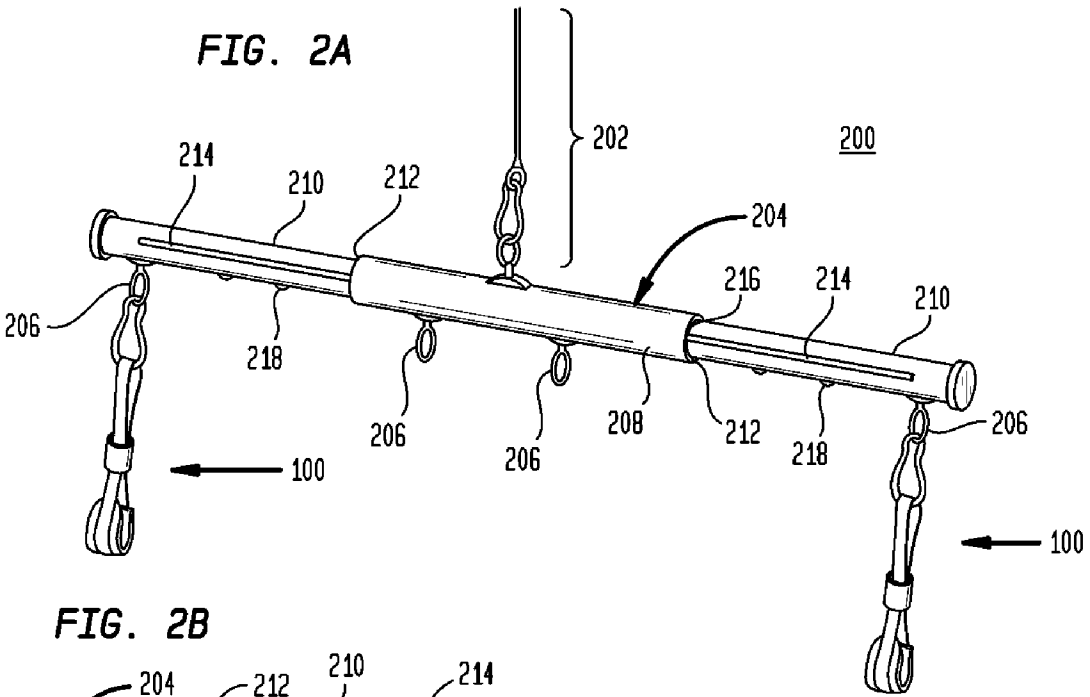
FIG. 2A is a perspective view of a weight lifting system 200 utilizing a pulley system 202 for lifting/lowering predefined weights, wherein two weight lifting apparatuses 100 are attached.
Figure 2B:
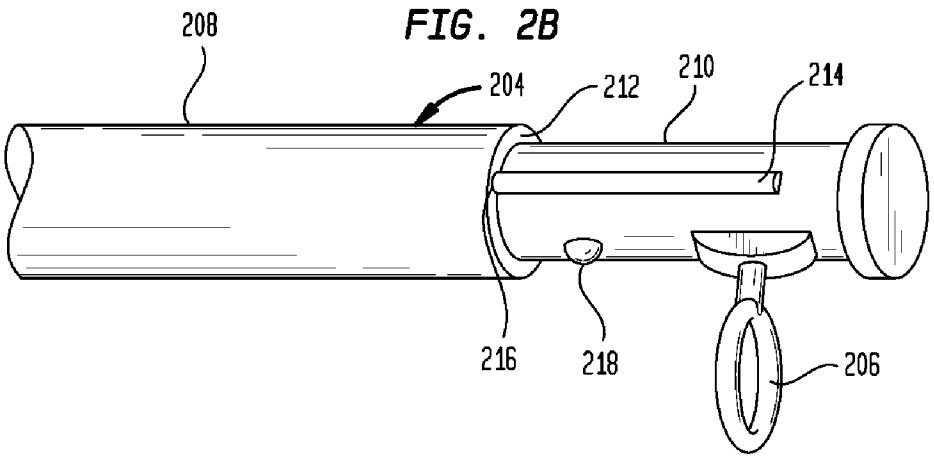
FIG. 2B is a perspective view of a portion of the telescoping cross bar 204 of the weight lifting system 200.
Figure 3A:
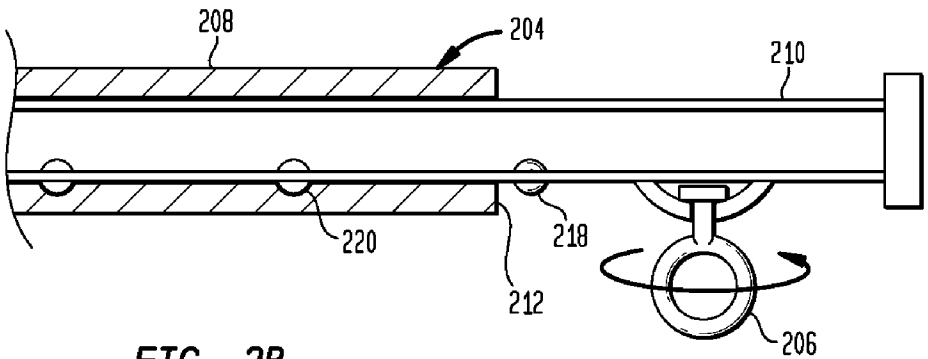
FIG. 3A is a planar view of a portion of the telescoping cross bar 204 of the weight lifting system 200.
Figure 3B:
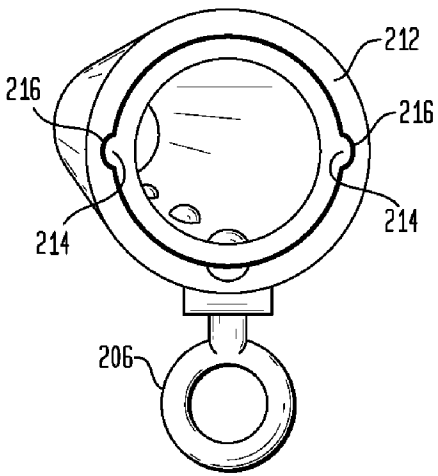
FIG. 3B is an expanded, perspective view of a portion of the telescoping cross bar 204 of the weight lifting system 200.

In use, the weight lifting apparatus 100 is removably attached to a telescoping bar 204 of a weight lifting system 200 as shown in FIGS. 2A and 2B. Specifically, the spring clip 114 is removably attached to a rotating ring 206 on an end of the telescoping bar 204. Further views of the telescoping bar 204 are shown in FIGS. 3A and 3B. The weight lifting system 200 has a pulley system 202 attached to weights or other means for providing resistance, a telescoping bar 204 attached to the pulley system 202, and rotating rings 206 to which the weight lifting apparatus 100 may be attached. Fixed rings or loops may be used in lieu of or in addition to the rotating rings 206. The telescoping bar 204 comprises a hollow center bar 208 having two ends 212 and two extendable bars 210, each extendable bar 210 being slidable in and out of an end 212 of the hollow center bar 208. Each extendable bar 210 preferably has at least one, and most preferably two, ridges 214 extending along the outer surface of the extendable bar 210. Each ridge 214 is received by a corresponding slot 216 extending along the inner surface of the hollow center bar 208. Thus, each extendable bar 210 slides straight in and out of the hollow center bar 208 without any twisting or rotating motion, as each ridge 214 in each extendable bar 210 is contained within a corresponding slot 216 in the hollow center bar 208. These features keep the rotating rings 206 aligned. A cap on the end of each extendable bar 210 preferably prevents each extendable bar 210 from being pushed too far into the hollow center bar 208.

The extendable bars 210 may optionally contain conventional spring loaded ball bearing catches 218 spaced at intervals along the length of each extendable bar 210, and the hollow center bar 208 may contain corresponding depressions 220 for receiving the spring loaded ball bearing catches 218. Thus, as the extendable bars 210 slide in and out of the hollow center bar 208, each extendable bar 210 may be temporarily held at predefined locations as the ball bearings in the spring loaded ball bearing catches 218 catch in the corresponding depressions 220. The spring loaded ball bearing catches 218 are preferably aligned with the rotating rings. The telescoping bar 204 is preferably made of a strong, durable, and rigid material such as metal, plastic, or composite. One preferred embodiment is constructed primarily of aluminum or similar metal such as iron or steel.

The spring clip 114 may alternatively be attached to a ring or loop on any part of a weight lifting bar, or to a weight lifting bar or handle itself. Alternatively, the attachment loop 120 may simply be slid or looped over the end of the telescoping bar 204 of the weight lifting system 200 as shown in FIG. 4. Or, the attachment loop 120 may be slid or looped over any part of a weight lifting bar or handle.

Figure 5:
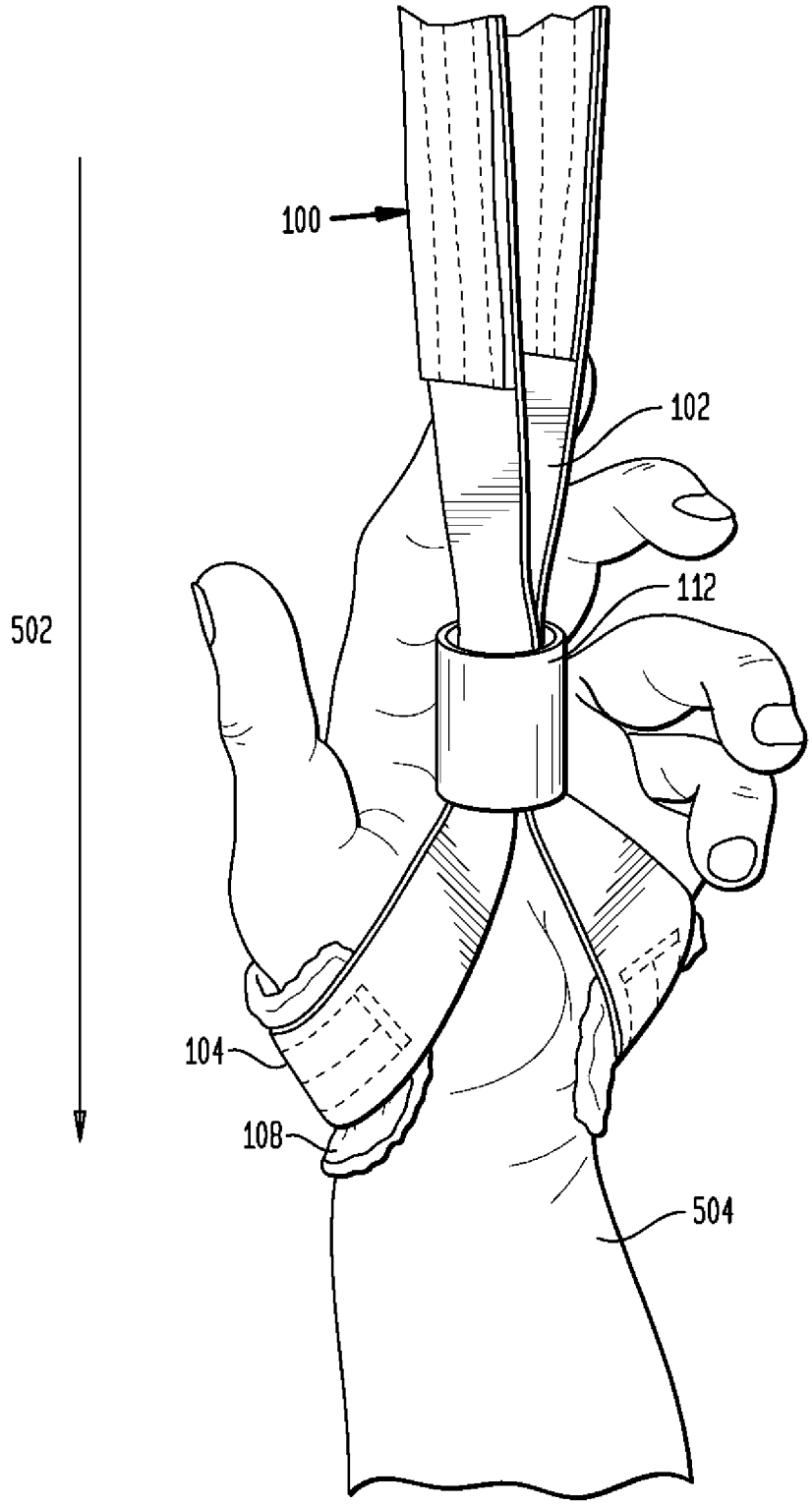
FIG. 5 is a perspective view of a user's hand engaging the weight lifting apparatus 100 by a preferred means and pulling downward 502.

Once the weight lifting apparatus 100 is removably attached to the weight lifting system 200, the user inserts his or her hand through the wrist loop 118 such that his or her palm comes into contact with the slidable sleeve 112, and the interior surface of the wrist loop 118 and/or the padding 108 contacts the user's wrist and/or the back side of the user's hand as shown in FIG. 5. The user may adjust the effective diameter of the wrist loop 118 by sliding the slidable sleeve 112 along the length of the strap 102 using his or her fingers and thumb. For example, the user may slide the slidable sleeve 112 toward the first end 104 of the strap 102 such that the wrist loop 118 fits snugly around the user's wrist. Alternatively, the user may slide the slidable sleeve 112 toward the second end 106 of the strap 102 such that the wrist loop 118 fits more loosely around the user's wrist. The exact placement or location of the slidable sleeve 112 along the length of the strap 102 is left up to the preference of the user.

Thereafter, the person simply loosely and gently rests his or her palm against the slidable sleeve 112 and/or the middle section 116 of the strap 102 during exercising. The user should not tightly grasp the slidable sleeve 112 and/or the middle section 116 of the strap 102. Once the weight lifting apparatus 100 is properly engaged, the user pulls downward 502 on the strap 102 while keeping his or her wrist in direct alignment with his or her hand and forearm. The downward 502 motion engages the pulley system 202 of the weight lifting system 200, and the user thereby pulls the weight, thereby exercising the desired muscles. Two weight lifting apparatuses 100 may also be used simultaneously, one for each hand, as shown in FIG. 2A.

The use of the preferred slidable sleeve 112, wrist loop 118, and attachment loop 120 is for convenience only. It would be readily apparent to one of ordinary skill in the relevant art to use a comparable means for changing the effective diameter of the wrist loop 118 as well as a comparable means for attaching the second end 106 of the strap 102 to a conventional weight lifting system 200 utilizing a pulley system 202. Furthermore, the dimensions and materials described herein are for convenience purpose only. It would be readily apparent to one of ordinary skill in the relevant art to use comparable dimensions, materials, and designs.

Figures 6A, 6B:
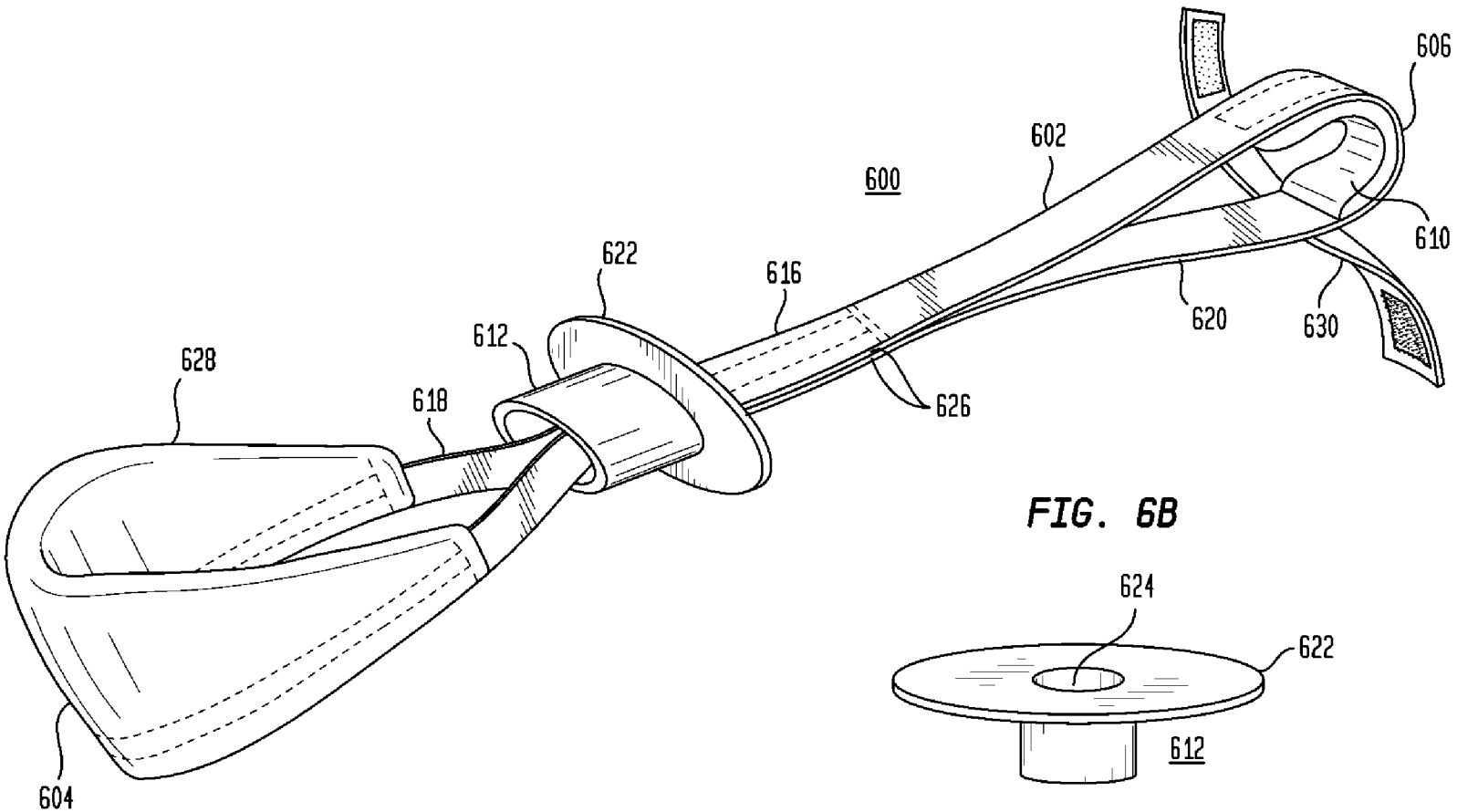
FIG. 6A is a perspective view of an alternative embodiment of a weight lifting apparatus 600 of the present invention.
FIG. 6B is a perspective view of a slidable handled sleeve 612 of the weight lifting apparatus 600.

For example, FIGS. 6A and 6B depict an alternative embodiment of the present invention. In this alternative embodiment, a alternative weight lifting apparatus 600 comprises a strap 602 folded and attached together in a continuous circle or loop. The strap 602 is preferably made of one and on-half inch wide nylon, although any other material having similar flexibility, strength, and durability may be used such as leather, canvas, fabric, etc. The strap 602 preferably has an overall circumference of about twenty-four inches, although differing sizes may be used based upon the gender or preference of the user. A sliding mechanism or slidable handled sleeve 612 encircles the strap 602. The slidable handled sleeve 612 is preferably a short tube having an inside diameter slightly smaller than the width of the strap 602. More specifically, the slidable handled sleeve 612 is preferably a one and one-half inch long section of oval plastic tubing having a greatest inside diameter of about one to one and one-half inches, as shown in FIG. 6B. Moreover, one end of the slidable handled sleeve 612 has a flare, flange, ridge, or handle 622. Thus, the slidable handled sleeve 612 is movably attached to the strap 602 by temporarily flattening or compressing at least a portion of the strap 602 such that the strap 602 can be threaded through the center hole 624 in the slidable handled sleeve 612. The slidable handled sleeve 612 can then be slid further along the strap 602 such that the slidable handled sleeve 612 is approximately centered on the strap 602. The strap 602 therefore has a first end 604, a middle section 616, and a second end 606, wherein the slidable handled sleeve 612 movably slides over the middle section 616. Moreover, a portion of the middle section is preferably attached together, preferably via stitching 626. The materials and dimensions described herein for the strap 602 and the slidable handled sleeve 612 are for convenience. It would be readily apparent to one of ordinary skill in the relevant art to use different materials and dimensions.

After the slidable handled sleeve 612 is positioned over the middle section 616, the strap 602 can be unflattened to form two loops separated by the stitching 626 in the middle section 616 and/or the slidable handled sleeve 612. A wrist loop 618 is formed at the first end 604, and an attachment loop 620 is formed at the second end 606. As the slidable handled sleeve 612 is positioned or slid along the middle section 616 of the strap 602, the effective diameters of the wrist loop 618 and the attachment loop 620 may increase or decrease accordingly. For example, as the slidable handled sleeve 612 slides over the wrist loop 618 toward the first end 604, the effective diameter of the wrist loop 618 decreases. Conversely, as the slidable handled sleeve 612 slides over the wrist loop 618 away from the first end 604, the effective diameter of the wrist loop 618 increases. On the other hand, as the slidable handled sleeve 612 slides over the attachment loop 620 toward the second end 606, the effective diameter of the attachment loop 620 decreases. Conversely, as the slidable handled sleeve 612 slides over the attachment loop 620 away from the second end 606, the effective diameter of the attachment loop 620 increases.

In the alternative embodiment of the present invention shown in FIG. 6A, a tapered cuff 628 is secured to the wrist loop 618. The tapered cuff 628 has a widest mid-portion at the first end 604 and thereafter gradually narrows along both arms of the tapered cuff 628 as they near the stitching 626. Each arm of the tapered cuff 628 preferably ends at about two inches from the stitching 626. The tapered cuff 628 is preferably attached to the wrist loop 618 along the non-tapered edge of the tapered cuff 628 using cuff stitching or glue. An internal cavity in the tapered cuff 628 preferably contains padding material made of a material that is soft, cushiony, pliant, etc., such as foam, cotton, neoprene, and the like. The outside surface of the tapered cuff 628 is preferably made of nylon or any other material having similar flexibility, strength, and durability such as leather, canvas, fabric, etc. The function of the tapered cuff 628 is to make the alternative weight lifting apparatus 600 more comfortable to use by providing a soft cushion between the wrist loop 618 and the user's wrist when the user inserts his it her hand and wrist through the wrist loop 618 and pulls on the alternative weight lifting apparatus 600. The tapered edge of the tapered cuff 628 serves to snugly cradle the user's wrist and back of the hand in order to make the alternative weight lifting apparatus 600 more comfortable to use. The tapered cuff 628 itself serves similar purposes as the padding 108 of the weight lifting apparatus 100. Preferred dimensions for the tapered cuff 628 are about six inches long and about two and one-half inches wide at the area of maximum width. However, the materials and dimensions described herein for the tapered cuff 628 are for convenience. It would be readily apparent to one of ordinary skill in the relevant art to use different materials and dimensions.

A protective pad 610 is also preferably secured to the interior surface of at least part of the attachment loop 620 at the second end 606. The protective pad 610 is preferably glued or stitched in place. The protective pad 610 is preferably generally rectangular in shape, about the same width as the attachment loop 620, and about four inches long. The protective pad 610 is preferably made of rubber or similar material that reduces slippage of the attachment loop 620 when it is placed on a bar 204, similar to the depiction in FIG. 4. The protective pad 610 also serves to reduce wear and tear on the attachment loop 620 through use of the alternative weight lifting apparatus 600 over time. Optionally, a spring clip 114, carabiner, or similar removable attachment device may be attached to the attachment loop 620. The materials and dimensions described herein for the protective pad 610 and the spring clip 114 are for convenience. It would be readily apparent to one of ordinary skill in the relevant art to use different materials and dimensions.

In addition, a securing strap 630 preferably is also secured to the attachment loop 620 such that the length of the securing strap 630 perpendicularly traverses the length of the alternative weight lifting apparatus 600. Specifically, the securing strap 630 is positioned and dimensioned such that it easily wraps around the attachment loop 620. The securing strap 630 is preferably stitched to the attachment loop 620 at about the midpoint of the length of the securing strap 630. Corresponding hook and loop fasteners are preferably stitched at each end of the securing strap 630 such that once the securing strap 630 is wrapped around the attachment loop 620, the corresponding hook and loop fasteners can be mated to keep the securing strap 630 wrapped around the attachment loop 620. The function of the securing strap 630 is to assist in keeping the attachment loop 620 in place on the bar 204 or any other attachment surface. Thus, once the attachment loop 620 is placed on the bar 204, the securing strap 630 may then be wrapped around the attachment loop 620 and fastened in place using the corresponding hook and loop fasteners, thereby keeping the attachment loop 620 from slipping or otherwise moving from its intended placement.

Figure 7:
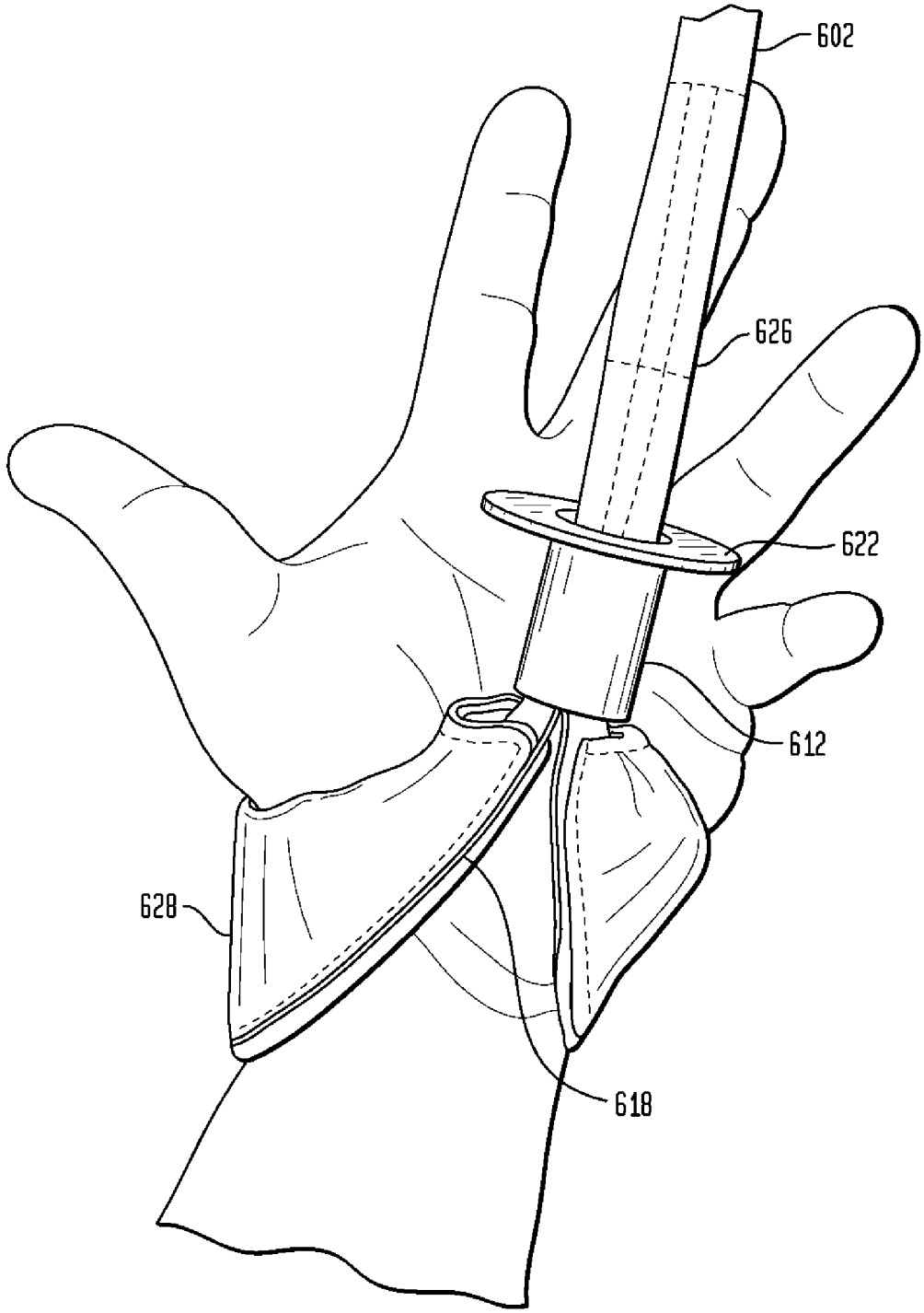
FIG. 7 is a perspective front view of a user's hand engaging the weight lifting apparatus 600 by a preferred means.
Figure 8:
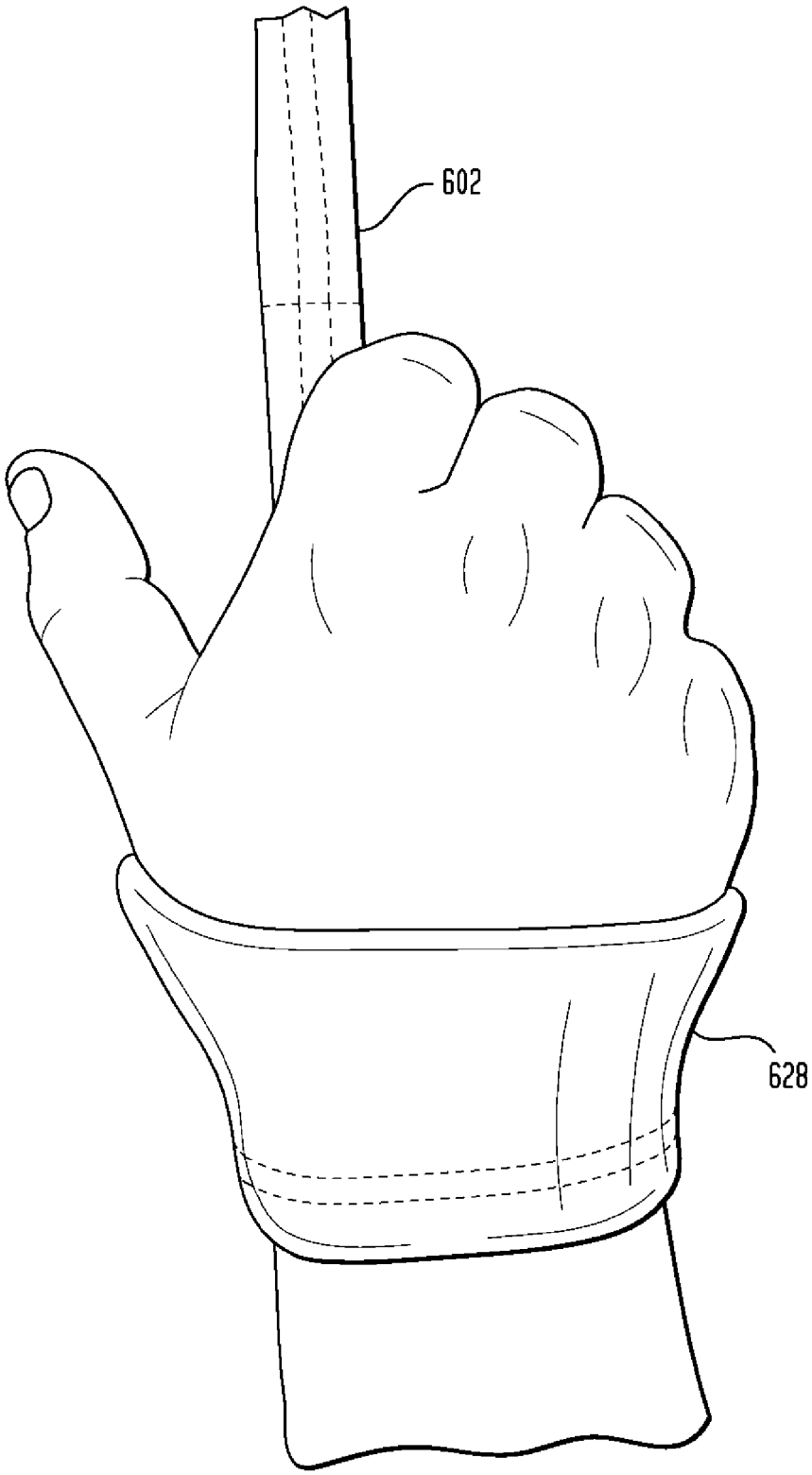
FIG. 8 is a perspective back view of a user's hand engaging the weight lifting apparatus 600 by a preferred means.
Figure 9:
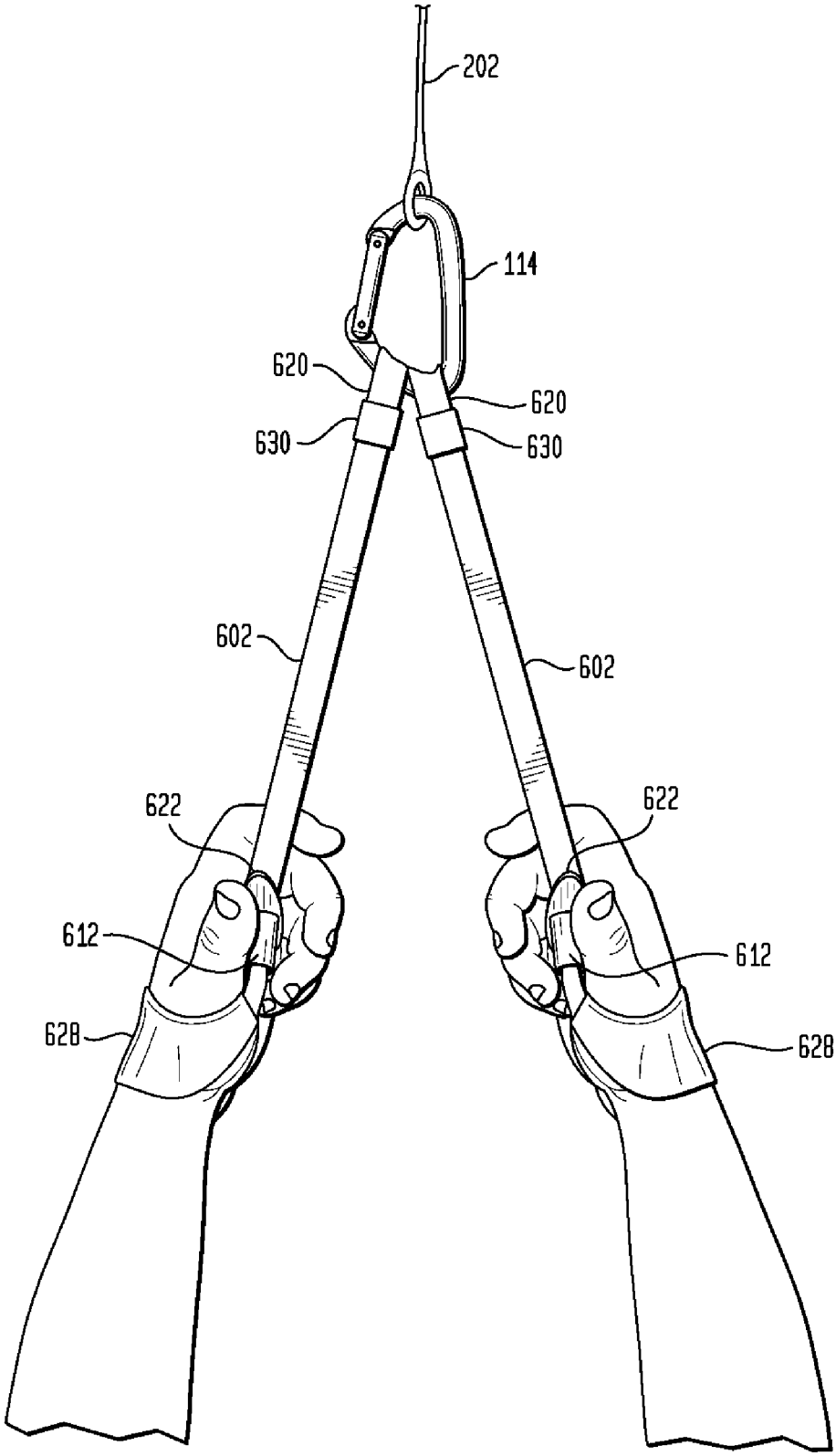
FIG. 9 is a perspective view of a user's hands engaging two weight lifting apparatuses 600 attached to a weight lifting system 200 using a preferred means.
Figure 10:
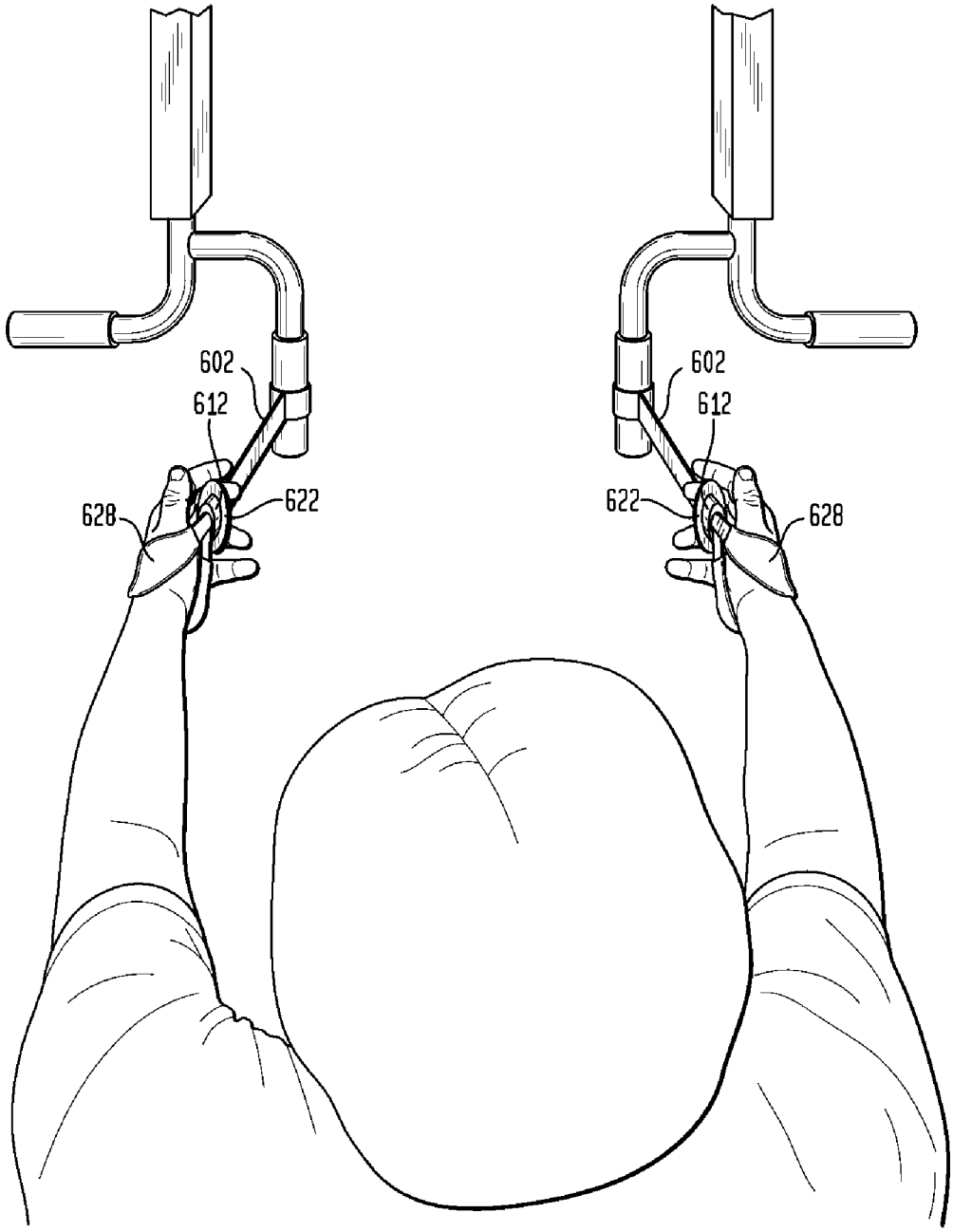
FIG. 10 is a perspective view of a user's hands engaging two weight lifting apparatuses 600 attached to a weight lifting system 200 using an alternative means.
Figure 11:
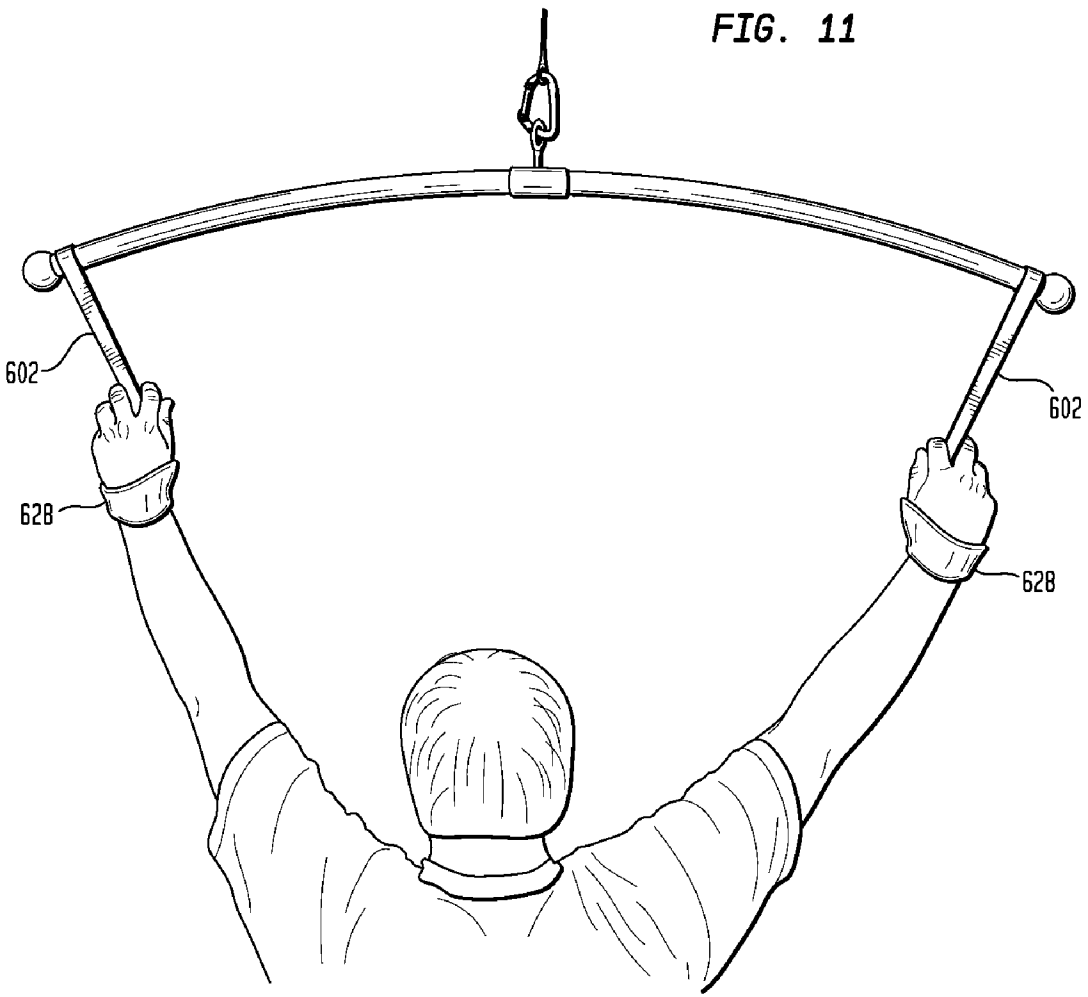
FIG. 11 is a perspective view of a user's hands engaging two weight lifting apparatuses 600 attached to a weight lifting system 200 using another alternative means.

The use of the alternative weight lifting apparatus 600 is analogous to the use of the weight lifting apparatus 100. In particular, the alternative weight lifting apparatus 600 is removably attachable to the telescoping bar 204 of a weight lifting system 200 or to any other device. The alternative weight lifting apparatus 600 is also attachable via the spring clip 114. Once the alternative weight lifting apparatus 600 is removably attached to the weight lifting system 200 or other device, the user inserts his or her hand through the wrist loop 618 such that his or her palm comes into contact with the slidable handled sleeve 612, and the interior surface of the wrist loop 618 and/or the tapered cuff 628 contacts the user's wrist and/or the back side of the user's hand as shown in FIGS. 7 and 8. The user may adjust the effective diameter of the wrist loop 618 by sliding the slidable handled sleeve 612 along the length of the strap 602 using his or her fingers and thumb. For example, the user may slide the slidable handled sleeve 612 toward the first end 604 of the strap 602 such that the wrist loop 618 and the tapered cuff 628 fit snugly around the user's wrist. Alternatively, the user may slide the slidable handled sleeve 612 toward the second end 606 of the strap 602 such that the wrist loop 618 fits more loosely around the user's wrist. The exact placement or location of the slidable handled sleeve 612 along the length of the strap 602 is left up to the preference of the user. The action by the user of sliding the slidable handled sleeve 612 along the strap 602 is facilitated by the presence on the slidable handled sleeve 612 of the handle 622. Specifically, the handle 622 provides a greater surface area for more easy and precise manipulation by the user's fingers and hand of the slidable handled sleeve 612. After placing his or her hand through the wrist loop 618 and adjusting the slidable handled sleeve 612, the user simply loosely and gently rests his or her palm against the slidable handled sleeve 612 and/or the middle section 616 of the strap 602 during exercising, similar to the use of the weight lifting apparatus 100. Two weight lifting apparatuses 600 may be used simultaneously, one for each hand, as shown in FIGS. 9-11.

The use of the preferred slidable handled sleeve 612, wrist loop 618, and attachment loop 620 is for convenience only. It would be readily apparent to one of ordinary skill in the relevant art to use a comparable means for changing the effective diameter of the wrist loop 618 as well as a comparable means for attaching the second end 606 of the strap 602 to a conventional weight lifting system 200 utilizing a pulley system 202. Furthermore, the dimensions and materials described herein are for convenience purpose only. It would be readily apparent to one of ordinary skill in the relevant art to use comparable dimensions, materials, and designs.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined only in accordance with the following claims and their equivalents.

What is claimed is:

1. A weight lifting device, comprising:

a strap formed by joining a first end and a second end of a single length of inelastic material to form a continuous loop, wherein said continuous loop comprises a wrist loop and an attachment loop both of which are formed by joining a length of opposing sections of said continuous loop to create a flat middle section between the wrist loop and the attachment loop, wherein the wrist loop and the attachment loop are approximately equal in diameter; and a cuff secured to the wrist loop, wherein said cuff is generally flat and is contoured to support a user's hand and wrist by providing a maximum width in the cuff at a point in the wrist loop which is furthest from the flat middle section between the wrist loop and the attachment loop, and which corresponds to the back of the user's hand when the strap is in use; and further wherein the width of the cuff tapers as the cuff encircles the wrist loop and approaches the flat middle section between the wrist loop and the attachment loop such that, when in use, the narrowest portions of the cuff extend around the ventral side of the user's hand and into the palm where the cuff ends near the flat middle section between the wrist loop and the attachment loop.

2. The weight lifting device of claim 1, wherein said strap is made of nylon.

3. The weight lifting device of claim 1, wherein said cuff has padding.

4. The weight lifting device of claim 3, wherein said cuff has an internal cavity into which the padding is added.

5. The weight lifting device of claim 1, further comprising protective padding secured to said attachment loop.

6. The weight lifting device of claim 5, wherein the protective padding is made of rubber.

7. The weight lifting device of claim 1, further comprising a securing strap removably wrapped around said attachment loop thereby decreasing an effective diameter of said attachment loop.

8. A weight lifting strap, comprising:

a single length of inelastic material having a first end and a second end, wherein the first and second ends of the length of inelastic material are joined to form a continuous loop, wherein a wrist loop and an attachment loop are formed in said continuous loop by joining a length of opposing sections of said continuous loop to create a flat middle section, which separates the wrist loop and the attachment loop;

a cuff secured to the wrist loop, wherein said cuff is generally flat and is contoured to support a user's hand and wrist, and further wherein the cuff is widest at a point in the wrist loop which is furthest from the flat middle section of the continuous loop and the width of the cuff narrows as the cuff extends toward said flat middle section of the continuous loop such that the cuff rests flush against the back of a human user's hand and wrist to relieve pressure along the back of the hand and wrist when the user is lifting weights using the strap, and further wherein said cuff has an internal cavity into which padding is added;

protective padding secured to said attachment loop; and a securing strap removably wrapped around said attachment loop thereby selectively decreasing an effective diameter of said attachment loop.

9. A method of making a weight lifting device, comprising:

joining a first and second end of a single length of inelastic material to form a continuous loop;

securing to one another a length of opposing sections of the continuous loop to form first and second end loops and a flat middle section between the first and second end loops; and attaching to the first end loop a cuff that is generally flat and is shaped to support a user's hand and wrist by providing a maximum width in the cuff at a point in the wrist loop which is furthest from the flat middle section of the strap and which corresponds to the back of the user's hand when the strap is in use, wherein the cuff is widest at a first end of the first loop and the width of the cuff narrows as the cuff extends toward the flat middle section of the continuous loop such that the cuff rests flush against the back of a human user's hand and wrist to relieve pressure along the back of the hand and wrist when the user is lifting weights using the strap, and further wherein said cuff has an internal cavity into which padding is added.

10. The method of claim 9, further comprising placing protective padding around the second end loop.

11. The method of claim 9, further comprising providing a securing strap removably wrapped around the second end loop for selectively decreasing an effective diameter of the second end loop.

* * * * *